US009711281B2

(12) United States Patent
Arroyo et al.

(10) Patent No.: US 9,711,281 B2
(45) Date of Patent: Jul. 18, 2017

(54) METHOD OF MANUFACTURING AN IGNITION COIL ASSEMBLY

(71) Applicant: DELPH TECHNOLOGIES, INC., Troy, MI (US)

(72) Inventors: Luis A. Arroyo, Cd. Juarez (MX); Jose J. Galicia, Cd. Juarez (MX)

(73) Assignee: DELPHI TECHNOLOGIES, INC, Troy, MI (US)

( * ) Notice: Subject to any disclaimer, the term of this patent is extended or adjusted under 35 U.S.C. 154(b) by 119 days.

(21) Appl. No.: 14/683,280

(22) Filed: Apr. 10, 2015

(65) Prior Publication Data

US 2015/0221435 A1 Aug. 6, 2015

Related U.S. Application Data

(62) Division of application No. 13/281,830, filed on Oct. 26, 2011, now Pat. No. 9,097,232.

(51) Int. Cl.

| | |
|---|---|
| ***H01F 41/12*** | (2006.01) |
| ***H01F 41/066*** | (2016.01) |
| ***F02P 3/04*** | (2006.01) |
| ***H01F 5/02*** | (2006.01) |
| *H01F 38/12* | (2006.01) |

(52) U.S. Cl.

CPC ..... *H01F 41/127* (2013.01); *F02P 3/04* (2013.01); *H01F 38/12* (2013.01); *H01F 41/066* (2016.01); *H01F 2005/025* (2013.01); *H01F 2038/122* (2013.01); *Y10T 29/49071* (2015.01); *Y10T 29/49073* (2015.01)

(58) Field of Classification Search

CPC .... H01F 5/02; H01F 2005/025; H01F 41/127; H01F 41/066; H01F 38/12; H01F 2038/122; Y10T 29/49071; Y10T 29/49073

See application file for complete search history.

(56) References Cited

U.S. PATENT DOCUMENTS

| | | | | |
|---|---|---|---|---|
| 3,106,691 | A * | 10/1963 | Maeda | H01F 17/041 336/136 |
| 5,485,135 | A * | 1/1996 | Hipp | H01F 5/02 336/107 |
| 6,781,500 | B2 | 8/2004 | Kawai et al. | |
| 6,897,755 | B2 | 5/2005 | Wada et al. | |
| 7,152,592 | B2 | 12/2006 | Rosemann | |
| 7,629,869 | B2 | 12/2009 | Fujiyama | |

* cited by examiner

*Primary Examiner* — Livius R Cazan
(74) *Attorney, Agent, or Firm* — Robert J. Myers

(57) ABSTRACT

A method of assembling the ignition coil assembly including a first spool, a first coil, and a second spool. The first coil is wound around a first spool outer surface. The first spool and the first coil are disposed within a cavity of the second spool and an electrically insulating material injected into an annular space defined between a first coil outer surface and a second spool inner surface. The first spool is configured to allow a decrease of a circumference of the first spool when the first coil is wound around an outer surface of the first spool. Decreasing the circumference of the first spool increases the annular space sufficient to inject the electrically insulating material into the annular space without creating substantial voids in the electrically insulating material.

9 Claims, 6 Drawing Sheets

METHOD OF MANUFACTURING AN IGNITION COIL ASSEMBLY

CROSS-REFERENCE TO RELATED APPLICATION

This application is a divisional application and claims the benefit under 35 U.S.C. 5121 of U.S. patent application Ser. No. 13/281,830 filed Oct. 26, 2011.

TECHNICAL FIELD OF THE INVENTION

The invention generally relates to a method of manufacturing an ignition coil assembly for a spark ignition internal combustion engine, and more particularly relates to a method of manufacturing an ignition coil having features that help to prevent voids in an electrically insulating material between the primary coil and the secondary coil.

BACKGROUND OF THE INVENTION

Ignition coil assemblies typically have an electrically insulating material between the primary coil and the secondary coil. Earlier ignition coil assembly designs used liquid oil as the electrically insulating material. Some more recent ignition coil assembly designs use epoxy resin-based materials as an electrically insulating material due to improved mechanical properties. Since epoxy resin-based materials typically harden, they may offer additional mechanical support to ignition coil components.

One disadvantage of epoxy resin-based materials, where filler content is part of the formulation, is the need for spaces to allow the proper flow of epoxy within coil sub assembles when it is poured or injected into the ignition coil assembly. The lack of spaces to allow the proper flow of epoxy may create voids in the material after it hardens. These voids may not offer enough dielectric strength to insulate a high voltage in the secondary coil from a lower voltage in the primary coil. This may cause arcing between the primary coil and the secondary coil that may result in a lower secondary voltage output and poor energy delivery from the ignition coil assembly. Arcing may also damage the ignition coil assembly. Therefore, it is preferable to avoid the formation of voids in the electrically insulating material between the primary coil and the secondary coil.

BRIEF SUMMARY OF THE INVENTION

In accordance with one embodiment of this invention, an ignition coil assembly is provided. The ignition coil assembly includes a magnetic core and a first spool that defines a first spool cavity. The magnetic core is disposed within the first spool cavity. The ignition coil assembly also includes a first coil. The first coil is wound around a first spool outer surface. The ignition coil further includes a second spool that defines a second spool cavity. The magnetic core, the first spool, and the first coil are disposed within the second spool cavity. The ignition coil assembly also includes an electrically insulating material injected into an annular space defined between a first coil outer surface and a second spool inner surface. The first spool is configured to allow a decrease of a first spool circumference when the first coil is wound around the first spool outer surface. Decreasing the first spool circumference increases the annular space sufficient to inject the electrically insulating material into the annular space without creating substantial voids in the electrically insulating material.

The first spool may define a slot configured to allow the decrease of the first spool circumference when the first coil is wound around the first spool outer surface.

In another embodiment of the present invention, a spool configured for use in an ignition coil assembly to receive a magnetic core within a cavity defined by the spool is provided. The spool includes a spool body. The spool body is configured to allow a decrease of a spool body circumference when a first coil is wound around a spool body outer surface.

The spool body may define a slot configured to allow the decrease of the spool body circumference when the first coil is wound around the spool body outer surface.

In yet another embodiment of the present invention, a method for assembling an ignition coil assembly is provided. The method includes the steps of providing a first spool, inserting a magnetic core within a cavity defined by the first spool, and winding a first coil around a first spool outer surface. The method also includes the steps of providing a second spool, inserting the first spool and the first coil within a cavity defined by the second spool, and injecting an electrically insulating material into an annular space defined between a first coil outer surface and a second spool inner surface. The step of providing the first spool includes configuring the first spool such that when the step of winding the first coil is performed, the annular space between the first coil outer surface and the second spool inner surface is sufficient to inject the electrically insulating material without creating substantial voids in the electrically insulating material.

The method may also include the step of providing a slot configured to allow a first spool circumference to decrease when the first coil is wound around the first spool outer surface.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF INVENTION

It may be desirable to minimize the space between the components of an ignition coil assembly to minimize the overall size of the ignition coil assembly. It has been observed that bubbles are more likely to form when injecting a thick electrically insulating material, such as an uncured epoxy resin material or a molten plastic material into a smaller space than when injecting the material into a larger space. The bubbles may form voids when the electrically insulating material hardens. These voids may diminish the electrical insulation properties of the material. The ignition coil assembly set forth herein includes features that help to increase the size of a space between internal components, thereby decreasing the likelihood of voids in the electrically insulating material, without increasing the overall size of the ignition coil assembly.

An ignition coil assembly may be constructed by inserting a magnetic core within a first spool around which a first coil is wound. The assembly of the magnetic core, the first spool and first coil may then be inserted into a second spool around which a second coil is wound. In order to prevent arcing between the first coil and the second coil, an electrically insulating material may be injected into an annular space between the first coil and the second spool inner surface. The size of the annular space may restrict the flow of the electrically insulating material through the annular space, thereby creating voids in the electrically insulating material that could cause arcing between the first coil and the second coil. In order to reduce the occurrence of such voids, the first spool may be configured to allow a decrease of a first spool circumference when the first coil is wound around the first spool outer surface. Decreasing the first spool circumference increases the annular space sufficiently to allow injection of the electrically insulating material into the annular space without creating substantial voids in the electrically insulating material.

Figure 1:
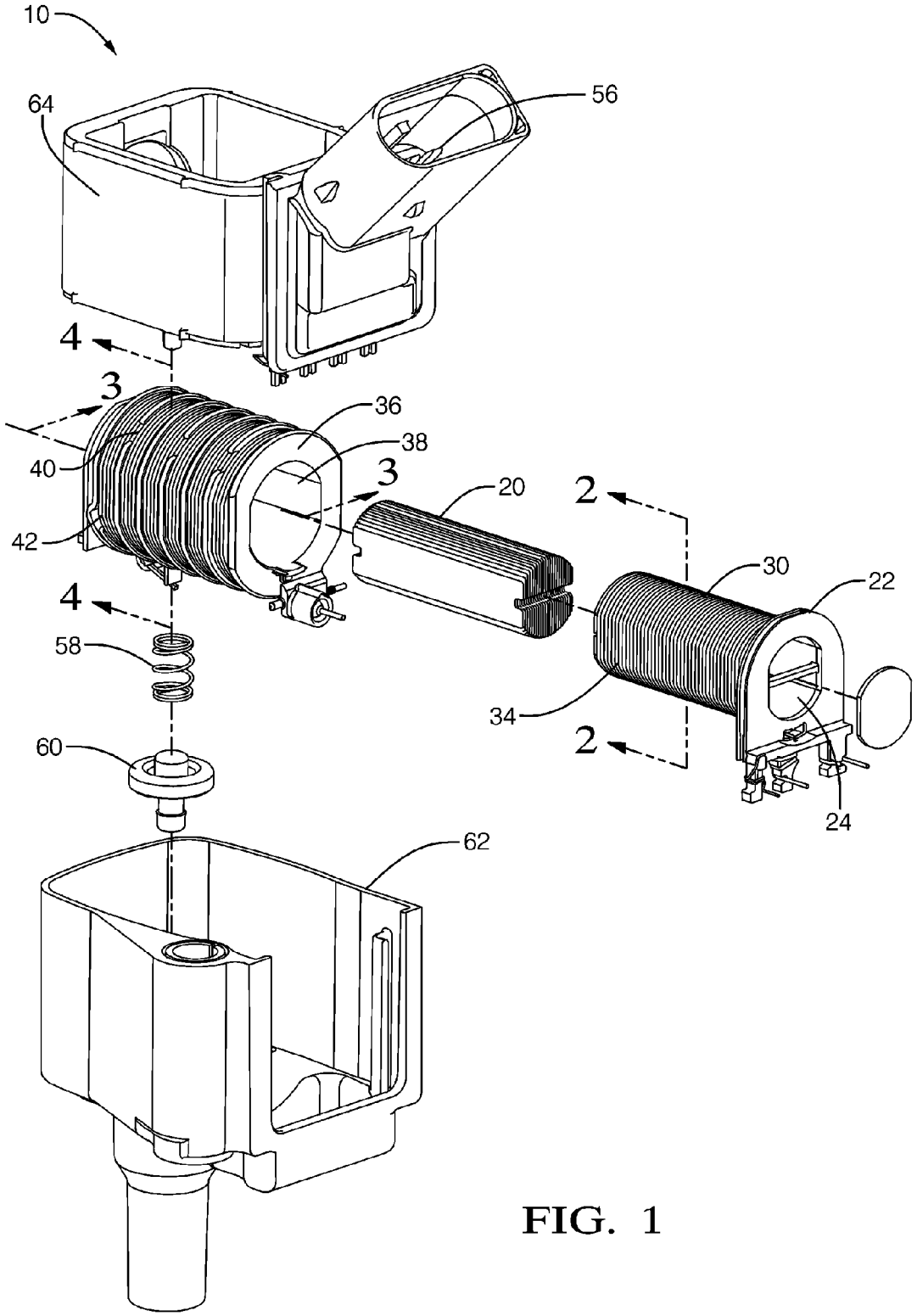
FIG. 1 is an illustration of an exploded perspective view of an ignition coil assembly in accordance with one embodiment.

FIG. 1 illustrates a non-limiting example of an ignition coil assembly 10. The ignition coil assembly 10 includes a magnetic core 20 that is made of a material that is suitable for conducting magnetic field energy and may be characterized as having a high magnetic permeability, such as silicon steel. The magnetic core 20 may be a laminated core constructed of sheets of magnetic material electrically insulated from each other to help reduce eddy currents from forming in the magnetic core 20. The laminated sheets of differing width may be formed into magnetic core 20 having a prismatic shape with a modified rectangular cross section. Hereinafter, a modified rectangle refers to a shape in which two opposing sides are convex arcs and the other two opposing sides are generally straight, of equal length, and parallel. As a non-limiting example, according to one particular embodiment, the magnetic core 20 may have a length of about 37 millimeters and a maximum width of 13.5 millimeters. The magnetic core 20 may also be formed into a generally cylindrical shape.

The ignition coil assembly 10 also includes a first spool 22 that defines a first spool cavity 24. As a non-limiting example, the first spool 22 and the first spool cavity 24 may be characterized by a modified rectangular cross section. The first spool 22 may be formed of an electrically non-conductive material, such as a resin-based plastic. As a non-limiting example, according to one particular embodiment, a first spool circumference 54 may be about 33.5 millimeters, prior to decreasing. A length of the first spool 22 may be about 37 millimeters. FIG. 1 illustrates the first spool 22 having two open ends. Other embodiments of the first spool 22 may be envisioned with one open first spool end and one closed first spool end. The magnetic core 20 may be disposed within the first spool cavity 24. The first spool 22 may also be formed into a generally cylindrical shape.

Figure 2:
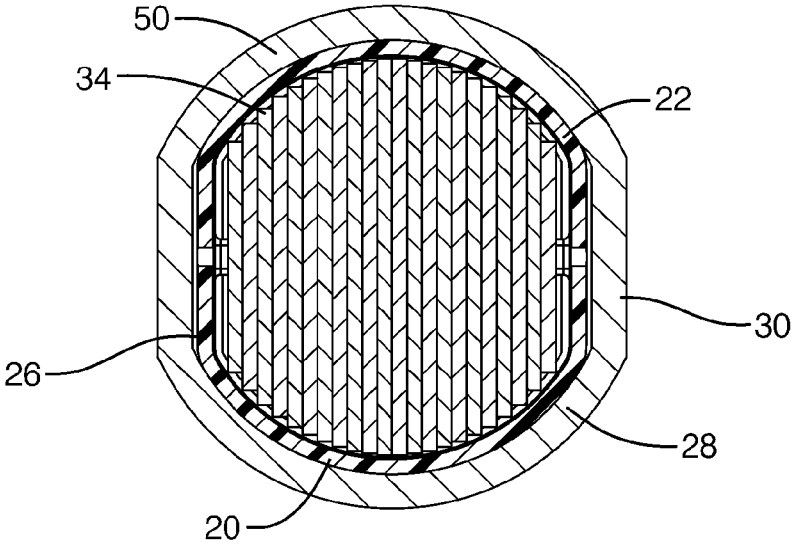
FIG. 2 is an illustration of a lateral cross section of a first coil in accordance with one embodiment.

Referring now to FIG. 2, to account for variations that may occur in the thickness of the laminated sheets used to construct the magnetic core 20, the first spool cavity 24 diameter may be selected so that there is a clearance 26 between the magnetic core 20 and a first spool inner surface 28 when a diameter of the magnetic core 20 is at a maximum expected tolerance. The first spool cavity 24 is preferably sized large enough that the magnetic core 20 may be easily inserted into the first spool cavity 24. Then, as will be described later, the clearance 26 may be reduced after a first coil wire 32 is wound onto a first spool outer surface 34, thereby reducing the first spool circumference 54. The first spool circumference 54 may be reduced until the first spool inner surface 28 is in intimate contact with the magnetic core 20.

Referring again to FIG. 1, the ignition coil assembly 10 also includes a first coil 30. The first coil 30 may be formed of the first coil wire 32. As a non-limiting example, the first coil wire 32 may be made of an electrically conductive material such as copper or aluminum with a thin electrically insulating coating, such as enamel. The first coil wire 32 may be helically wound around the first spool outer surface 34. As a non-limiting example, according to one particular embodiment, the diameter of the first coil wire 32 may be 0.54 millimeters (23.4 AWG). The number of times the first coil wire 32 is wrapped around the outer surface of the first spool 22 may be 110. The tension of the first coil wire 32 when it is wrapped around the first spool outer surface 34 may be about 15.7 Newtons. The coil wire size, the number of times the coil wire is wrapped around the first spool 22 and the tension used to wrap the first coil wire 32 will vary depending on the ignition coil assembly 10 design and application.

Continuing to refer to FIG. 1, the ignition coil assembly 10 further includes a second spool 36 defining a second spool cavity 38. The second spool 36 may be formed of an electrically non-conductive material, such as a resin-based plastic. As a non-limiting example, the second spool 36 and the second spool cavity 38 may be characterized by a modified rectangular cross section. The second spool 36 may also be formed into a generally cylindrical shape. As a non-limiting example, according to one particular embodiment, a width of the second spool cavity 38 may be about 17.2 millimeters. The second coil 40 may be formed of a second coil wire 42. As a non-limiting example, the second coil wire 42 may be made of an electrically conductive material such as copper or aluminum with a thin electrically insulating coating, such as enamel. The second coil wire 42 may be helically wound around a second spool outer surface 44. As a non-limiting example, according to one particular embodiment, the diameter of second coil wire 42 may be 0.0028 millimeters (41 AWG). The number of times that the second coil wire 42 is wrapped around the outer surface of the second spool 36 may be 10510. The tension of the second coil wire 42 when it is wrapped around the second spool outer surface 44 may be about 0.28 Newtons. The coil wire size, the number of times the coil wire is wrapped around the second spool 36 and the tension used to wrap the second coil wire 42 will vary depending on the ignition coil assembly 10 design and application.

Figure 3:
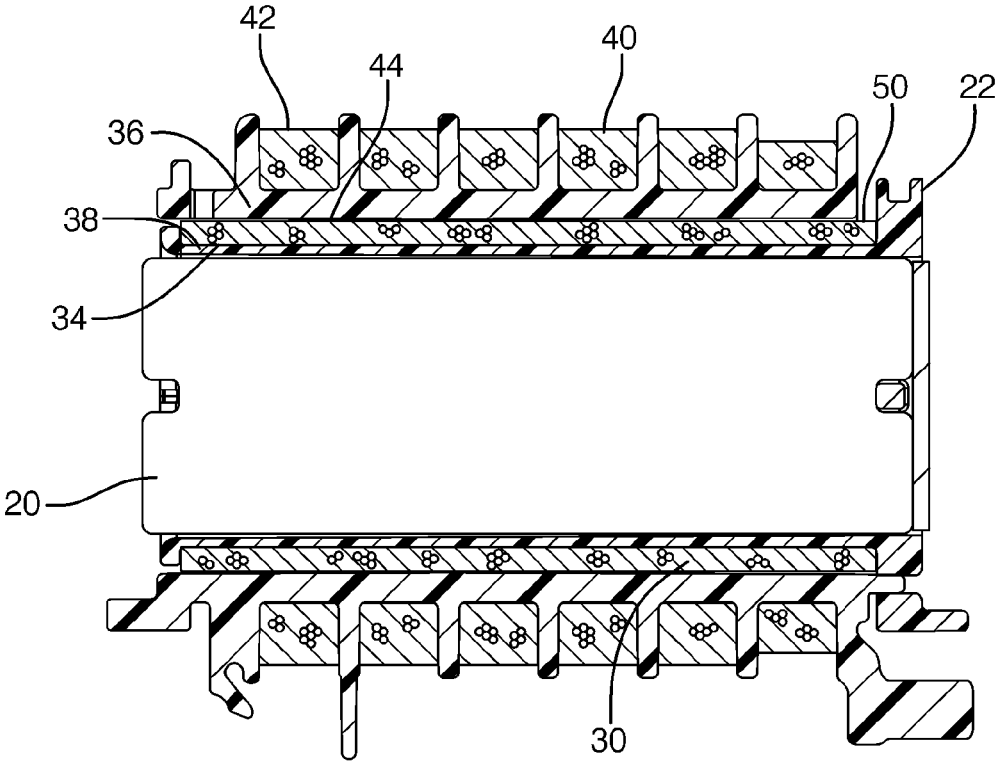
FIG. 3 is an illustration of an axial cross section of a second coil in accordance with one embodiment.

As shown in FIG. 3, the magnetic core 20, the first spool 22, and the first coil 30 are disposed within the second spool cavity 38. An electrically insulating material 46, such as liquid epoxy resin, is injected into an annular space 48 defined between a first coil outer surface 50 and a second spool inner surface 52. The liquid epoxy resin may then harden to form the electrically insulating material 46. A vacuum of 50 to 90 Pascal may be applied to the second spool cavity 38 to facilitate filling of the annular space 48 completely with the electrically insulating material 46. FIG. 3 illustrates a non-limiting example of the second spool 36 having two open ends. Other embodiments of the second spool 36 may be envisioned with one open second spool end and one closed second spool end.

Figure 4:
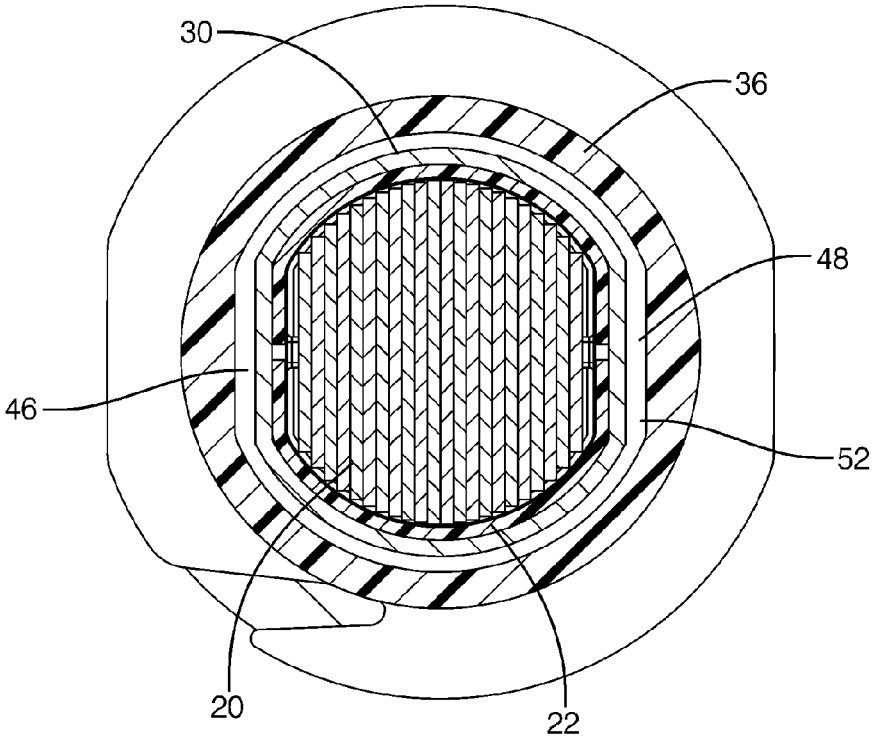
FIG. 4 is an illustration of a lateral cross section of the second coil in accordance with one embodiment.

Referring now to FIG. 4, the first spool 22 is configured to allow a decrease of the first spool circumference 54 when the first coil 30 is wound around the first spool outer surface 34. As non-limiting examples, tension in the first coil wire 32 may cause the decrease the first spool circumference 54 or the first spool circumference 54 may be decreased by a clamping device while the first coil 30 is wound around the first spool outer surface 34.

Figure 5:
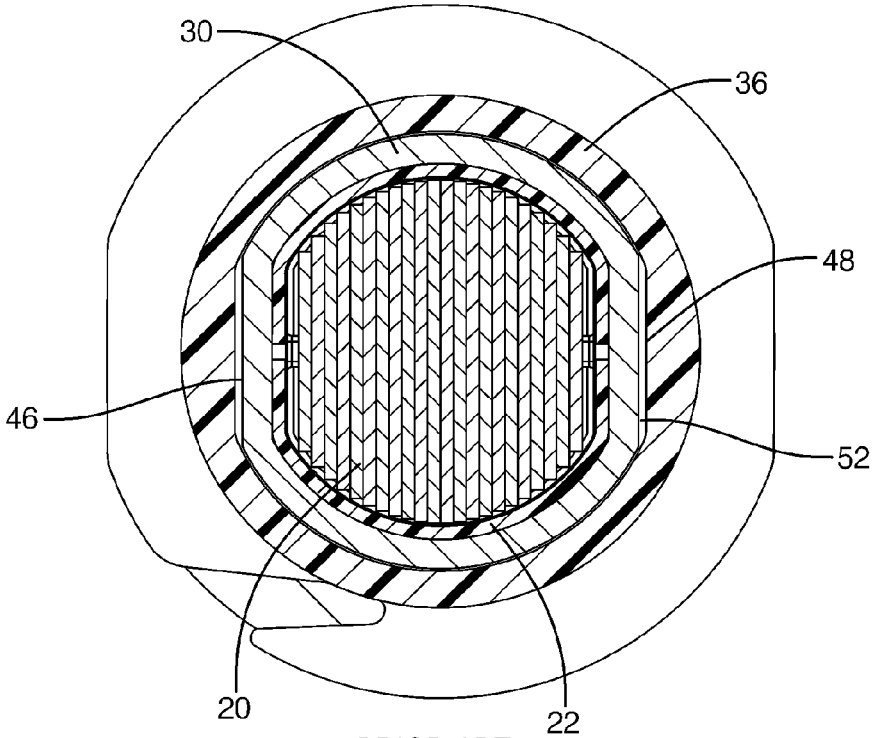
PRIOR ART FIG. 5
FIG. 5 is an illustration of a lateral cross section of the second coil, as used in the prior art.

Decreasing the first spool circumference 54 increases an annular space 48 sufficient to inject an electrically insulating material 46 into the annular space 48 without creating substantial voids in the electrically insulating material 46. In the prior art, without decreasing the first spool circumference 54, the annular space 48 may have typically been about 0.08 millimeters for a first spool circumference of about 33.5 millimeters and a second spool cavity diameter of about 17.1 millimeters, see FIG. 5. In these conditions, voids often formed in the electrically insulating material 46. As shown in FIG. 4, by decreasing the first spool circumference 54, the annular space 48 was increased, and it was observed that fewer voids were present in the electrically insulating material 46 when the annular space 48 was at least 0.4 millimeters. The voids may be formed by bubbles in the electrically insulating material 46 when it is injected into the annular space 48. Hereinafter, substantial voids are those voids that are visible to the naked eye or approximately 0.1 mm in diameter. In addition to electrically insulating the first coil 30, the electrically insulating material 46 may also fix the first coil 30 and second spool 36 in physical relation to one another.

After the first coil 30 is wound upon the first spool outer surface 34, a portion of a first spool inner surface 28 may be in intimate contact with the magnetic core 20.

Figure 6:
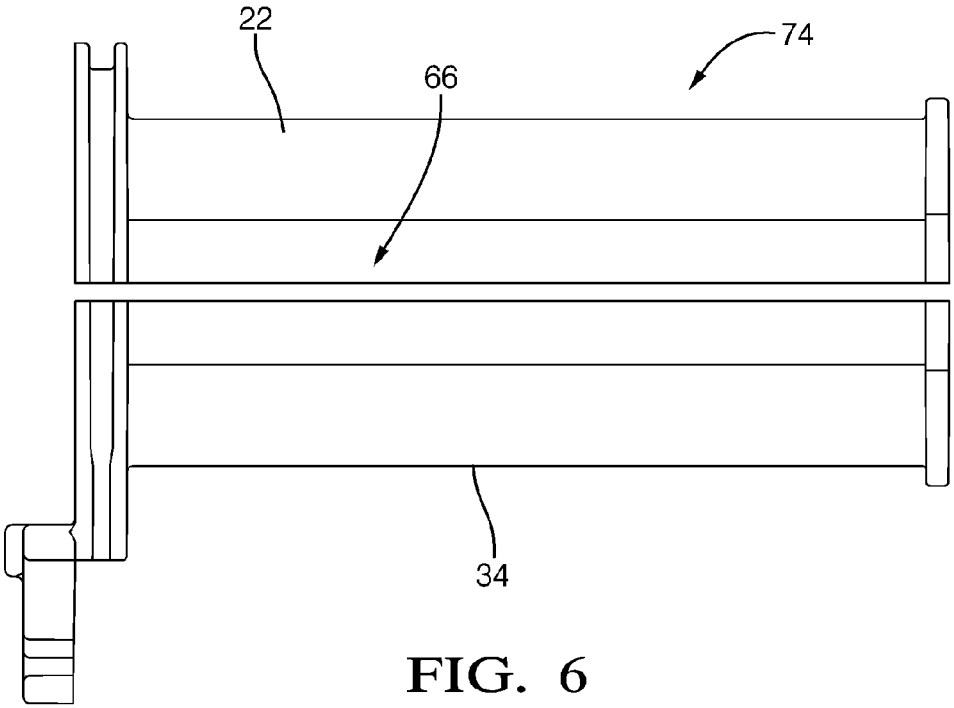
FIG. 6 is an illustration of a side view of a first spool defining a slot configured to allow the decrease of the first spool circumference when the first coil is wound around the first spool outer surface.

FIG. 6 illustrates an embodiment of the first spool 22 that defines a slot 66 configured to allow the decrease of the first spool circumference 54 when the first coil 30 is wound around the first spool outer surface 34. As shown in FIG. 2, the slot 66 may extend the entire length of the first spool 22.

Figure 7:
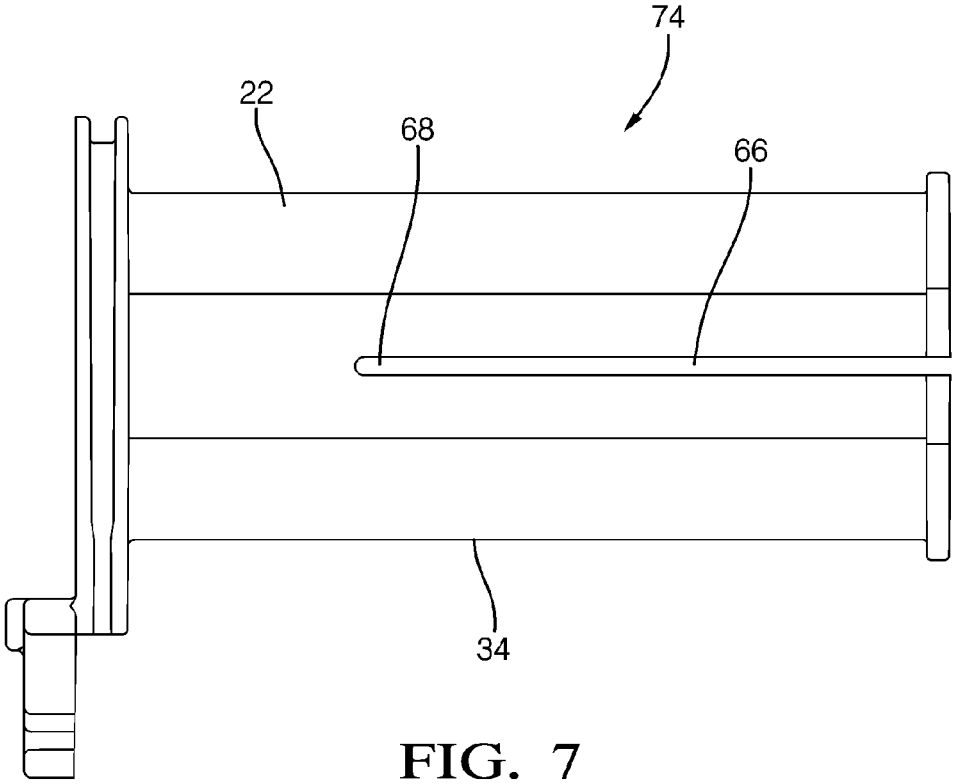
FIG. 7 is an illustration of a side view of a first spool defining a slot configured to allow the decrease of the first spool circumference when the first coil is wound around the first spool outer surface, wherein the slot defines a closed end.

FIG. 7 illustrates an embodiment of the first spool 22 wherein the slot 66 may define a closed end 68. As a non-limiting example, according to one particular embodiment, the length of the slot 66 may be about 25 millimeters from an open end of the first spool 22 to the closed end 68.

Figure 8:
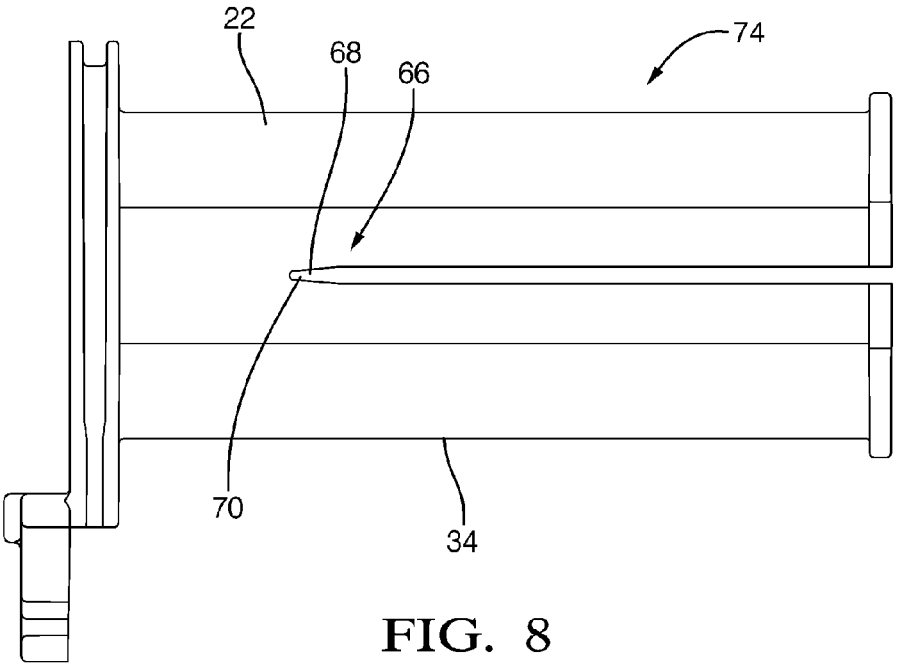
FIG. 8 is an illustration of a side view of a first spool defining a slot configured to allow the decrease of the first spool circumference when the first coil is wound around the first spool outer surface, wherein the slot defines a closed end and wherein the closed end defines a V-shape.

FIG. 8 illustrates an embodiment of the first spool 22 wherein the slot 66 may define a V-shape 70 at the closed end 68. Without prescribing to any particular theory, the V-shape 70 may lower the risk of crack propagation in the electrically insulating material 46 due to laminations in the magnetic core 20 being exposed to the electrically insulating material 46.

Figure 9:
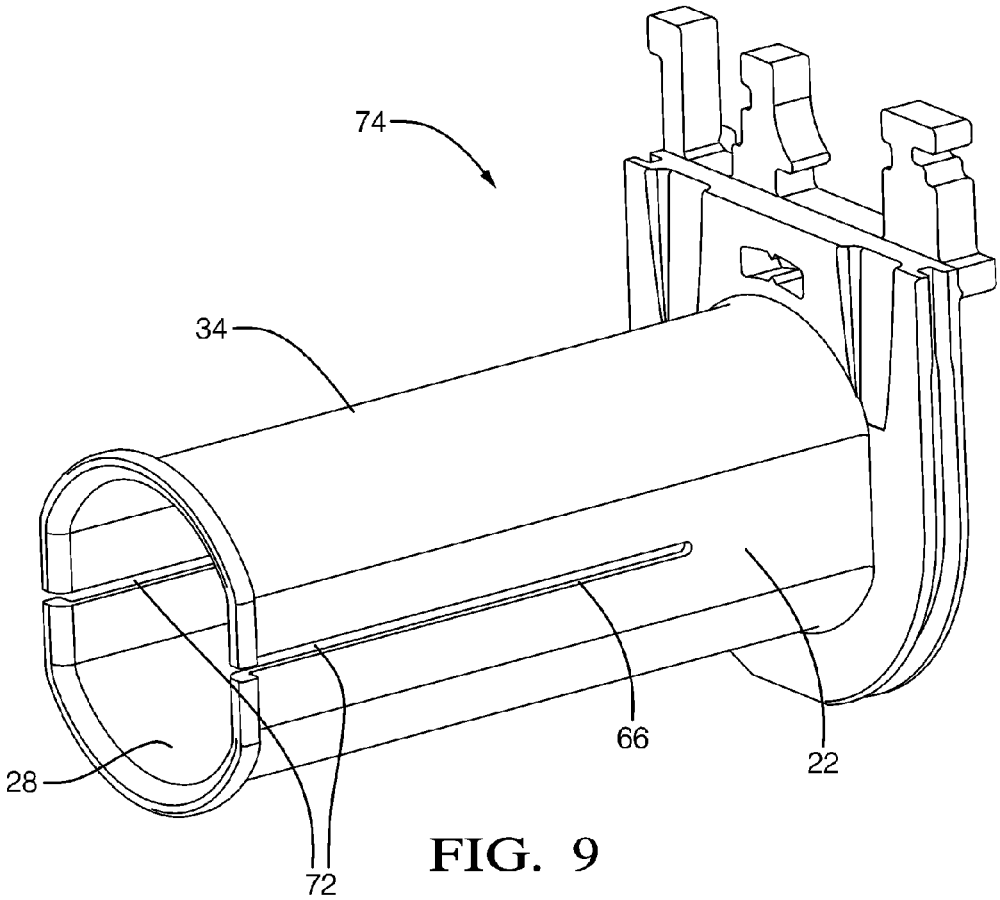
FIG. 9 is an illustration of a perspective view of a first spool defining a plurality of slots configured to allow the decrease of the first spool circumference when the first coil is wound around the first spool outer surface.

FIG. 9 illustrates an embodiment of the first spool 22 wherein the first spool 22 may define a plurality of slots 72. The plurality of slots 72 may be spaced substantially equidistant on the first spool circumference 54. Hereinafter, substantially equidistant means that the tolerance difference in the distance on the first spool circumference 54 from one slot 66 to any other slot 66 in the plurality of slots 72 is ±2 mm. As a non-limiting example, according to one particular embodiment, the spacing for 2 slots 72 arranged about a first spool 22 having a first spool circumference 54 of 33.5 millimeters may be 16.75 millimeters±2 millimeters. The width of each slot 66 in the plurality of slots 72 may be about 0.6 mm.

Referring once again to FIG. 1, the ignition coil assembly 10 may also include a first coil connector 56 and a second coil connector 58. In a non-limiting example, the ignition coil assembly 10 may be constructed to be attached directly to a spark plug in an internal combustion engine. The second coil connector 58 may be connected to a spark plug terminal 60 that may be configured to be connected to the spark plug (not shown). The first spool 22 and the second spool 36 may be housed within an ignition coil case 62 and a magnetic shield 64. The magnetic shield 64 may be constructed of an electrically and magnetically conductive material, such as silicon steel. The ignition coil case 62 may be filled with the electrically insulating material 46, whereby the first coil 30, the second coil 40 and the other parts may be encapsulated.

FIG. 1 illustrates an embodiment wherein the first coil 30 is a primary coil and the second coil 40 is a secondary coil. Other embodiments may be envisioned wherein the first coil 30 is a secondary coil and the second coil 40 is a primary coil. In the embodiment illustrated in FIG. 1, the ignition coil assembly 10 is structured such that an electric voltage input to the first coil 30 creates a magnetic field that induces a voltage in the second coil 40. The number of times that the second coil wire 42 is wound around the second spool 36 is greater than the number of times that the first coil wire 32 is wound around the first spool 22. Therefore, the voltage induced in the second coil 40 will be higher than the voltage applied to the first coil 30. As a non-limiting example, according to one particular embodiment, a ratio of the number of windings in the first coil 30 to the number of windings in the second coil 40 may be about 1 to 100. The wire diameter of the second coil wire 42 may be smaller than the wire diameter of the first coil wire 32.

FIG. 6 illustrates a non-limiting example of a spool 74 configured for use in an ignition coil assembly 10 to receive a magnetic core 20 within a cavity 24 defined by the spool 74, the spool 74 includes a spool body 22, wherein the spool body 22 is configured to allow a decrease of a spool body circumference 54 when a first coil 30 is wound around a spool body outer surface 34. As a non-limiting example, according to one particular embodiment, the spool body circumference 54 may be about 33.5 millimeters, prior to decreasing. A length of the spool body 22 may be about 37 millimeters.

After the first coil 30 is wound upon the spool body outer surface 34 the decrease of the spool body circumference 54 may cause a portion of a spool body inner surface 28 to be in intimate contact with the magnetic core 20. As non-limiting examples, tension in the first coil wire 32 may cause the decrease the spool body circumference 54 or the spool body circumference 54 may be decreased by a clamping device while the first coil 30 is wound around the spool body outer surface 34. As a non-limiting example, according to one particular embodiment, the tension of the first coil wire 32 when it is wrapped around the spool body outer surface 34 may be about 15.7 Newtons. The spool body 22 may define a slot 66 configured to allow the decrease of the spool body circumference 54 when the first coil 30 is wound around the spool body outer surface 34.

FIG. 7 illustrates an embodiment of the spool 74 wherein the slot 66 may define a closed end 68. As a non-limiting example, according to one particular embodiment, the length of the slot 66 may be about 25 millimeters from an open end of the spool body 22 to the closed end 68.

FIG. 8 illustrates an embodiment of the spool 74 wherein the slot 66 may define a V-shape 70 at the closed end 68. Without prescribing to any particular theory, the V-shape 70 may lower the risk of crack propagation in the electrically insulating material 46 due to laminations in the magnetic core 20 exposed to the electrically insulating material 46.

FIG. 9 illustrates an embodiment of the spool 74 wherein the spool body 22 may define a plurality of slots 72. The plurality of slots 72 may be spaced substantially equidistant on the spool body circumference 54. As a non-limiting example, according to one particular embodiment, the spacing for 2 slots 72 arranged about a spool body 22 having a spool body circumference 54 of 33.5 millimeters may be 16.75 millimeters±2 millimeters. The width of each slot 66 in the plurality of slots 72 may be about 0.6 mm.

Figure 10:
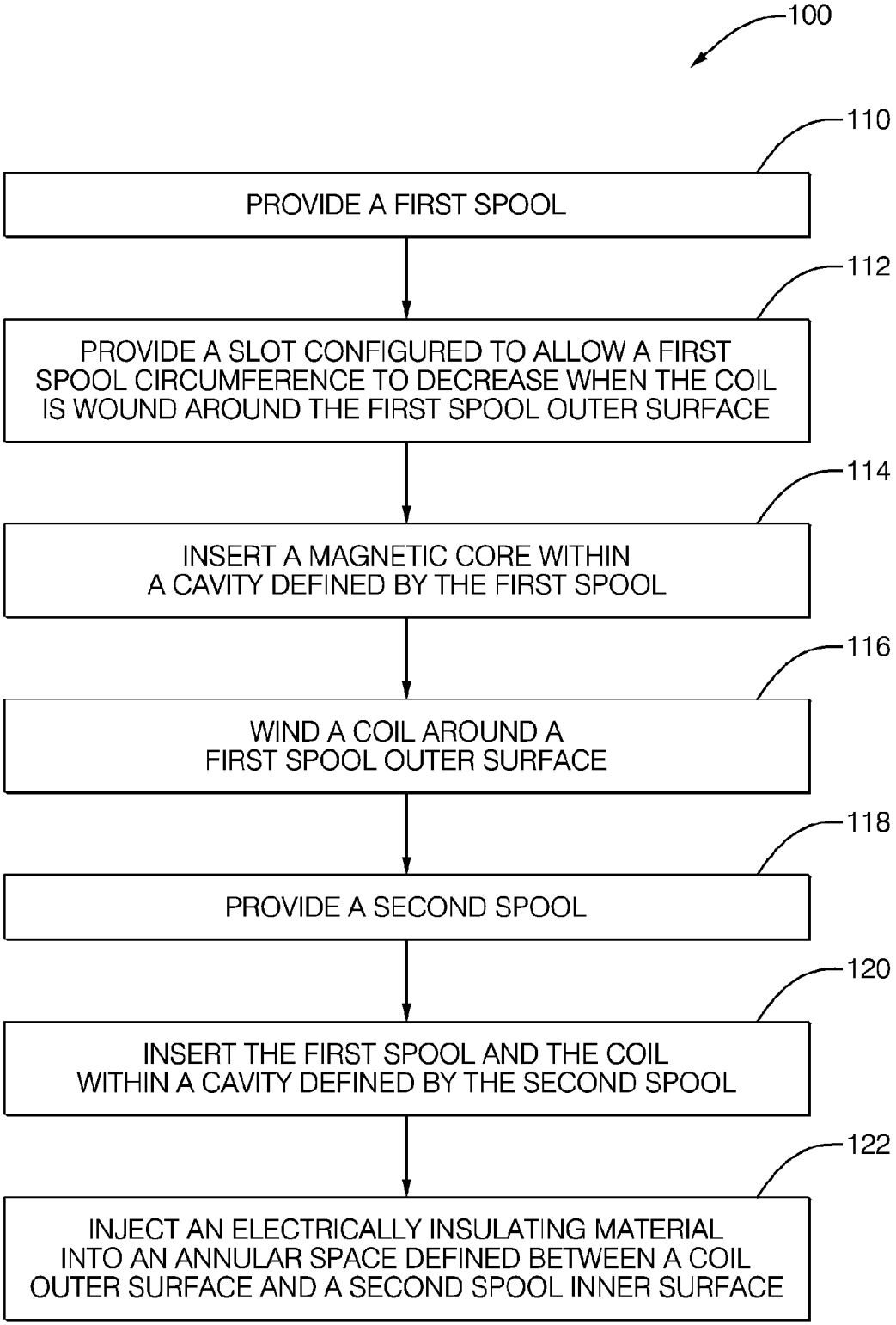
FIG. 10 is a flow diagram of a method for assembling an ignition coil assembly.

FIG. 10 illustrates a method 100 for assembling an ignition coil assembly 10. The method 100 may include a step 110 PROVIDE A FIRST SPOOL that may include providing the first spool 22.

The method 100 may include a step 114 INSERT A MAGNETIC CORE WITHIN A CAVITY DEFINED BY THE FIRST SPOOL that may include inserting the magnetic core 20 within the first spool cavity 24.

The method 100 may include a step 116 WIND A COIL AROUND A FIRST SPOOL OUTER SURFACE that may include winding the first coil wire 32 forming the first coil 30 around the first spool outer surface 34. The first coil wire 32 may be wound in a helical pattern. As a non-limiting example, according to one particular embodiment, the diameter of the first coil wire 32 may be 0.54 millimeters (23.4 AWG) and the diameter of the second coil wire 42 may be 0.0028 millimeters (41 AWG). The number of times the first coil wire 32 is wrapped around the outer surface of the first spool 22 may be 110 and the number of times that the second coil wire 42 is wrapped around the outer surface of the second spool 36 may be 10510. The tension of the first coil wire 32 when it is wrapped around the first spool outer surface 34 may be about 15.7 Newtons. The tension of the second coil wire 42 when it is wrapped around the second spool outer surface 44 may be about 0.28 Newtons. The coil wire size, the number of times the coil wire is wrapped around the spool 74 and the tension used to wrap the coil wire will vary depending on the ignition coil assembly 10 design and application.

The method 100 may include a step 118 PROVIDE A SECOND SPOOL that may include providing the second spool 36.

The method 100 may include a step 120 INSERT THE FIRST SPOOL AND THE COIL WITHIN A CAVITY DEFINED BY THE SECOND SPOOL that may include inserting the magnetic core 20, first spool 22 and the first coil 30 within the second spool cavity 38.

The method 100 may include a step 122 INJECT AN ELECTRICALLY INSULATING MATERIAL INTO AN ANNULAR SPACE DEFINED BETWEEN A COIL OUTER SURFACE AND A SECOND SPOOL INNER SURFACE that may include injecting an electrically insulating material 46 into an annular space 48 defined between the first coil outer surface 50 and the second spool inner surface 52. The electrically insulating material 46 may be an epoxy resin-based material. The epoxy-resin based material may be in a liquid state when injected into the annular space 48 and may later harden to a more solid state.

Step 122 INJECT AN ELECTRICALLY INSULATING MATERIAL INTO AN ANNULAR SPACE DEFINED BETWEEN A COIL OUTER SURFACE AND A SECOND SPOOL INNER SURFACE may include applying a vacuum to the annular space 48 while injecting the electrically insulating material 46. The vacuum applied may typically be between 50 and 90 Pascal. The electrically insulating material 46 may be an epoxy-based material.

Step 110 PROVIDE A FIRST SPOOL includes configuring the first spool 22 such that when step 116 WIND A COIL AROUND A FIRST SPOOL OUTER SURFACE is performed, the annular space 48 between the first coil outer surface 50 and the second spool inner surface 52 is sufficient to inject the electrically insulating material 46 without creating substantial voids in the electrically insulating material 46.

The method 100 may further include a step 112 PROVIDE A SLOT CONFIGURED TO ALLOW A FIRST SPOOL CIRCUMFERENCE TO DECREASE WHEN THE COIL IS WOUND AROUND THE FIRST SPOOL OUTER SURFACE that may include providing a slot 66 configured to allow a first spool circumference 54 to decrease when the first coil 30 is wound around the first spool outer surface 34. As non-limiting examples, tension in the first coil wire 32 may cause the decrease the first spool circumference 54 or the first spool circumference 54 may be decreased by a clamping device while the first coil 30 is wound around the spool body outer surface 34. The slot 66 may define a closed end 68. The closed end 68 of the slot 66 may define a V-shape 70. A plurality of slots 72 may be provided. The plurality of slots 72 may be spaced substantially equidistant on the first spool circumference 54.

Accordingly, an ignition coil assembly 10, a spool 74 for the ignition coil assembly 10 and a method 100 for assembling the ignition coil assembly 10 is provided. The ignition coil assembly 10 includes the first spool 22, the first coil 30, and the second spool 36. The first coil 30 is wound around the first spool outer surface 34. The first spool 22 is configured to allow a decrease of a circumference of the first spool 22 when the first coil 30 is wound around an outer surface of the first spool 22.

The first spool 22 and the first coil 30 are disposed within a cavity 24 of the second spool 36, thereby defining an annular space 48 between the outer surface of the first coil 30 and the inner surface of the second spool 36. Decreasing the circumference of the first spool 22 increases the annular space 48 sufficient to inject the electrically insulating material 46 into the annular space 48 without creating substantial voids in the electrically insulating material 46. Voids in the electrically insulating material 46 may cause arcing between the first coil 30 and the second coil 40, thereby reducing the electrical performance of the ignition coil assembly 10 and possibly damaging the ignition coil assembly 10.

The first spool 22 may define a slot 66 that is configured to allow the decrease of the first spool circumference 54 when said first coil 30 is wound around the first spool outer surface 34. The slot 66 may have a closed end 68 and the closed end 68 of the slot 66 may have a V-shape 70. The V-shape 70 may lower the risk of crack propagation in the electrically insulating material 46 that may be caused by laminations in the magnetic core 20 being exposed in contact with the electrically insulating material 46. The first spool 22 may define a plurality of slots 72.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A method for assembling an ignition coil assembly, comprising:

providing a first spool defining a slot configured to allow a first spool circumference to decrease;

inserting a magnetic core within a cavity defined by the first spool;

winding a first coil around a first spool outer surface;

decreasing the circumference of the first spool;

providing a second spool;

inserting the first spool and the first coil within a cavity defined by the second spool; and injecting an electrically insulating material into an annular space defined between a first coil outer surface and a second spool inner surface, wherein the step of providing the first spool includes configuring the first spool such that after the step of decreasing the circumference of the first spool, the annular space between the first coil outer surface and the second spool inner surface is sufficient to inject the electrically insulating material without creating substantial voids in the electrically insulating material.

2. The method of claim 1, wherein the slot defines an open end and a closed end.

3. The method of claim 2, wherein the slot defines a V-shape at the closed end.

4. The method of claim 2, wherein the first spool defines a plurality of slots.

5. The method of claim 1, wherein the step of injecting the electrically insulating material into the annular space defined between the first coil outer surface and the second spool inner surface includes applying a vacuum while injecting the electrically insulating material.

6. The method of claim 1, wherein the electrically insulating material is an epoxy-based material.

7. The method of claim 1, wherein the step of decreasing the circumference of the first spool is performed during the step of winding a first coil around a first spool outer surface by tension in the first coil wire.

8. The method of claim 1, wherein the step of decreasing the circumference of the first spool is performed prior to the step of winding a first coil around a first spool outer surface by a clamping device applied to the first spool.

9. The method of claim 1, wherein the circumference of the first spool is decreased during the step of decreasing the circumference of the first spool until the first spool inner surface is in intimate contact with the magnetic core.

* * * * *